US009214114B2

(12) United States Patent
Liu

(10) Patent No.: US 9,214,114 B2
(45) Date of Patent: Dec. 15, 2015

(54) METHOD FOR ADJUSTING GAMMA CURVE AND GAMMA VOLTAGE GENERATOR AND DISPLAY CONTROL SYSTEM THEROF

(71) Applicant: Hung-Ta Liu, Hsinchu (TW)

(72) Inventor: Hung-Ta Liu, Hsinchu (TW)

( * ) Notice: Subject to any disclaimer, the term of this patent is extended or adjusted under 35 U.S.C. 154(b) by 100 days.

(21) Appl. No.: 14/175,520

(22) Filed: Feb. 7, 2014

(65) Prior Publication Data

US 2014/0225942 A1 Aug. 14, 2014

(30) Foreign Application Priority Data

Feb. 8, 2013 (TW) ..... 102105381 A

(51) Int. Cl.

| | |
|---|---|
| ***G09G 5/10*** | (2006.01) |
| ***G09G 3/36*** | (2006.01) |
| ***G09G 3/20*** | (2006.01) |
| *G09G 3/34* | (2006.01) |

(52) U.S. Cl.

CPC .. *G09G 3/36* (2013.01); *G09G 3/20* (2013.01); *G09G 3/3406* (2013.01); *G09G 2320/0242* (2013.01); *G09G 2320/0276* (2013.01); *G09G 2320/0646* (2013.01); *G09G 2320/0673* (2013.01); *G09G 2360/16* (2013.01)

(58) Field of Classification Search

CPC ..... G09G 3/36; G09G 5/10; G09G 3/34; G09G 5/00; G09G 3/30; G06F 3/038; H04N 5/202

USPC ..... 345/87, 89, 100, 211, 690

See application file for complete search history.

(56) References Cited

U.S. PATENT DOCUMENTS

| | | | | |
|---|---|---|---|---|
| 2004/0189574 | A1 * | 9/2004 | Lee et al. | 345/95 |
| 2009/0085937 | A1 * | 4/2009 | Woo et al. | 345/690 |
| 2011/0175942 | A1 * | 7/2011 | Ahn et al. | 345/690 |
| 2013/0271507 | A1 * | 10/2013 | Kim et al. | 345/690 |
| 2013/0300773 | A1 * | 11/2013 | Kim | 345/690 |

FOREIGN PATENT DOCUMENTS

| | | |
|---|---|---|
| TW | I286725 | 9/2007 |
| TW | I299149 | 7/2008 |
| TW | 201015529 A | 4/2010 |
| TW | I326443 | 6/2010 |

* cited by examiner

*Primary Examiner* — Pegeman Karimi

(74) *Attorney, Agent, or Firm* — Li & Cai Intellectual Property (USA) Office

(57) ABSTRACT

A method for adjusting a gamma curve used in a display control system of a display apparatus, and the method comprises steps of: analyzing each sub pixel gray value distribution of each color in a frame; and adjusting at least a gamma reference voltage according to the sub pixel gray value distribution of the color, such that a gray level voltage number corresponding to the sub pixel gray values in at least a predetermine region which has the relative large statistical number or ratio is increased, and a gray level voltage number corresponding to the sub pixel gray values in at least a predetermine region which has the relative low statistical number or ratio is decreased.

23 Claims, 7 Drawing Sheets

METHOD FOR ADJUSTING GAMMA CURVE AND GAMMA VOLTAGE GENERATOR AND DISPLAY CONTROL SYSTEM THEROF

BACKGROUND

1. Technical Field

The present disclosure relates to a display apparatus; in particular, to a method for adjusting gamma curve for a display control system and a gamma voltage generator thereof.

2. Description of Related Art

Display technology is currently undergoing rapid evolvement. The liquid crystal display (LCD) is widely utilized as an image output apparatus for various electronic devices. A liquid crystal particle in the LCD rotates according to an applied voltage, for controlling transmittance of a corresponding sub-pixel.

Please refer to FIG. 1. FIG. 1 is a partial block diagram illustrating a conventional display control system. As shown in FIG. 1, a gamma voltage generator 11 of the conventional display control system receives a system voltage AVDD and generates a plurality of gamma reference voltages $V_{GMA_1}$~$V_{GMA_N}$ according to a plurality of resistors 112 coupled in series. A gray level voltage generator 122 of a source driving circuit 12 in the conventional display control system generates gray level voltages $V_{g1}$~$V_{gn}$ according to the plurality of gamma reference voltages $V_{GMA_1}$~$V_{GMA_N}$ respectively.

As shown in FIG. 1, the gray level voltages $V_{g1}$~$V_{gi}$ are generated according to the gamma reference voltages $V_{GMA_1}$~$V_{GMA_2}$. The gray level voltages $V_{gk}$~$V_{gn}$ are generated according to the gamma reference voltages $V_{GMA_N-1}$~$V_{GMA_N}$. Similarly, other gray level voltages can be generated according to two consecutive gamma reference voltages $V_{GMA_i-1}$~$V_{GMA_i}$. Subsequently, the conventional display control system generates a plurality of control signals $X_1$~$X_L$ according to a sub-pixel gray value of each sub-pixel respectively. The source driving circuit 12 receives the control signals $X_1$~$X_L$ corresponding to the respective sub-pixels. The source driving circuit 12 then selects one of the gray level voltages $V_{g1}$~$V_{gn}$ as a driving voltage $Y_1$~$Y_L$ for each corresponding sub-pixel, according to the respective control signals $X_1$~$X_L$ received, so as to control a rotation of each corresponding liquid crystal.

Please refer to FIG. 2. FIG. 2 is a diagram illustrating a gamma curve corresponding to a conventional liquid crystal display panel. As shown in FIG. 2, the vertical axis represents driving voltages corresponding to liquid crystals of the sub-pixels and the horizontal axis represents gray values corresponding to the sub-pixels. Since resistances of the plurality of resistors 112 coupled in series are constant, voltage values of the gamma reference voltages $V_{GMA_1}$~$V_{GMA_N}$ are also constant which cannot be adjusted so the gamma curve cannot be adjusted either.

Generally, human eyes are more sensitive to details in the dark than in the light. Hence a gray level voltage number corresponding to a plurality of sub-pixels with relatively large gray values is relatively small (i.e. quantized to a relatively lesser extent), and a gray level voltage number corresponding to a plurality of sub-pixels with relatively small gray values is relatively large (i.e. quantized to a relatively greater extent), for maintaining display saturation of a frame.

For maintaining display saturation of the frame, resistances of the plurality of resistors 112 can be designed in a manner such that a larger voltage difference exists between two consecutive gamma reference voltages $V_{GMA_1}$~$V_{GMA_2}$. A gray level voltage number corresponding to a plurality of sub-pixels with relatively large gray values is therefore decreased (i.e. quantized to a relatively lesser extent), and a gray level voltage number corresponding to a plurality of sub-pixels with relatively small gray values is increased (i.e. quantized to a relatively greater extent).

Take FIG. 2 as an example. Sub-pixels with gray values 255~176 can correspond to 10 gray level voltages generated by two consecutive gamma reference voltages $V_{GMA_1}$~$V_{GMA_2}$ with a larger voltage difference. On the other hand, sub-pixels with gray values 44~0 can correspond to 10 gray level voltages generated by two consecutive gamma reference voltages $V_{GMA_N-1}$~$V_{GMA_N}$ with a smaller voltage difference.

However, since gray values of a plurality of sub-pixels of a frame can concentrate towards a certain value range, if the gamma curve or the gamma reference voltages $V_{GMA_1}$~$V_{GMA_N}$ cannot be dynamically adjusted, contrast of the frame is deteriorated, consequently lowering the display quality.

SUMMARY

An exemplary embodiment of the present disclosure provides a method for adjusting a gamma curve for a display control system of a display apparatus. The method comprises analyzing a pixel gray value distribution of each frame and a sub-pixel gray value distribution of each color; and dynamically adjusting at least a gamma reference voltage, a curvature and a function according to the pixel gray value distribution and the sub-pixel gray value distribution of each color, for increasing a gray level voltage number corresponding to a plurality of pixel gray values and sub-pixel gray values in at least a predetermined region which has a relatively larger statistical number or a relatively higher ratio, and decreasing a gray level voltage number corresponding to a plurality of pixel gray values and sub-pixel gray values in at least a predetermined region which has a relatively smaller statistical number or a relatively lower ratio.

Another exemplary embodiment of the present disclosure provides a gamma voltage generator. The gamma voltage generator comprises a plurality of resistors, a plurality of buffer amplifiers and a plurality of control voltage generators. The plurality of resistors is coupled in series. A first resistor of the plurality of resistors coupled in series is electrically connected to a system voltage. A last resistor of the plurality of resistors coupled in series is electrically connected to a ground voltage. A connection point of any two neighboring resistors is for outputting a corresponding gamma reference voltage. An output terminal of each of the buffer amplifiers is electrically connected to a connection point of two corresponding neighboring resistors. Each of the plurality of buffer amplifiers is asserted by a corresponding enabling selection signal. An output terminal of each of the plurality of control voltage generators is electrically connected to an input terminal of a corresponding buffer amplifier, and each of the plurality of control voltage generators receives a corresponding voltage adjusting signal to generate a voltage signal.

Another exemplary embodiment of the present disclosure provides a display apparatus. The display control system analyzes each pixel gray value distribution of each frame and a sub-pixel gray value distribution of each color. The display control system dynamically adjusts at least a gamma reference voltage, a curvature and a function according to the pixel gray value distribution and the sub-pixel gray value distribution of each color, for increasing a gray level voltage number corresponding to a plurality of sub-pixel gray values in at least a predetermined region which has a relatively larger statistical number or a relatively higher ratio, and decreasing a gray level voltage number corresponding to a plurality of sub-pixel gray values in at least a predetermined region which has a relatively smaller statistical number or a relatively lower ratio.

In summary, the method for adjusting a gamma curve according to embodiments of the present disclosure can increase the contrast and the display quality of a frame. In addition, the gamma voltage generator according to embodiments of the present disclosure is simple structured and easy to realize. The gamma voltage generator can adjust the generated gamma reference voltages via a control circuit, for increasing the contrast and the display quality.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
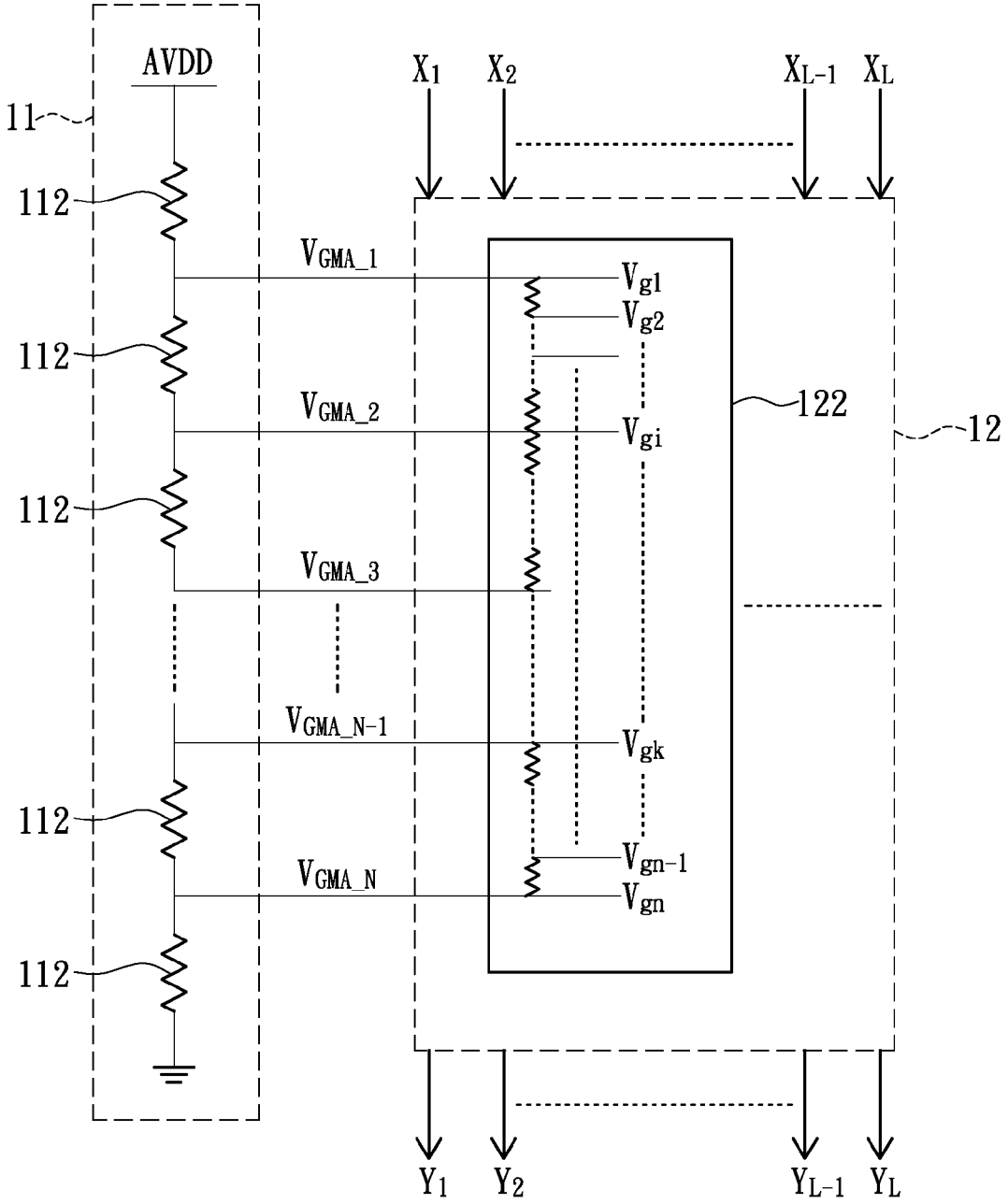
FIG. 1(PRIOR ART)
FIG. 1 is a partial block diagram illustrating a conventional display control system.

Reference will now be made in detail to the exemplary embodiments of the present disclosure, examples of which are illustrated in the accompanying drawings. Wherever possible, the same reference numbers are used in the drawings and the description to refer to the same or like parts.

(An Embodiment of a Method for Adjusting a Gamma Curve)

Figure 3:
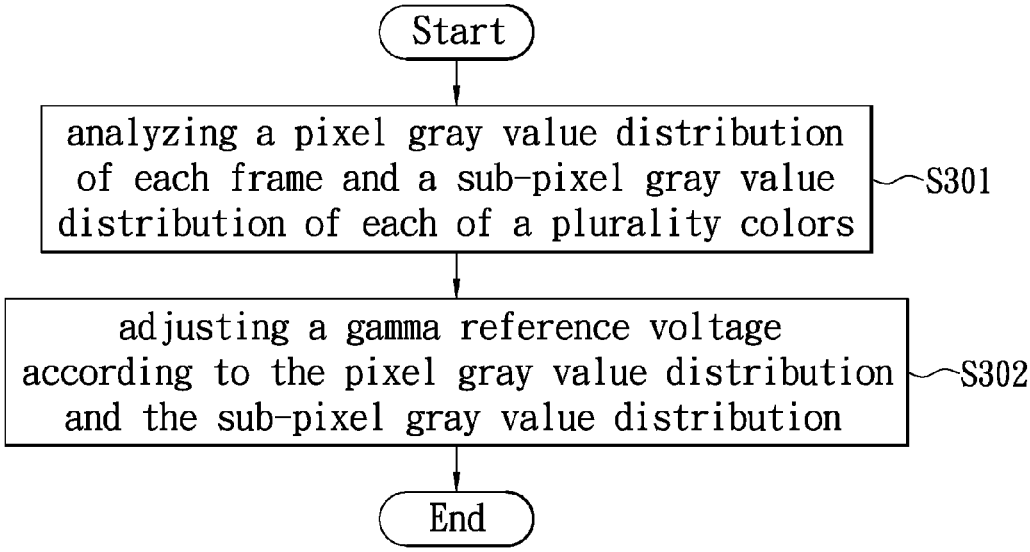
FIG. 3 is a flow chart illustrating a method for adjusting a gamma curve according to an embodiment of the present disclosure.

Please refer to FIG. 3. FIG. 3 is a flow chart illustrating a method for adjusting a gamma curve according to an embodiment of the present disclosure. The method for adjusting the gamma curve is utilized in a display control system and can be realized via hardware or a combination of software and hardware. The display control system can be utilized for backlight or a self-light-emitting display apparatus, such as a liquid crystal display (LCD) device or an organic light emitting diode display (LED) device.

Firstly, in step S301, a sub-pixel gray value distribution of a frame is analyzed by a control circuit (e.g. a timing controller) of the display control system or a front end operating system, such that a statistical number and a statistical ratio of the sub-pixel gray values of the frame in each predetermined region are calculated. For instance, a statistical number or a statistical ratio of red sub-pixel gray values 0~44, 45~175 and 176~255 of the frame is calculated. Further, each predetermined region can be adjusted according to practical needs.

In step S302, a corresponding gamma reference voltage is adjusted according to the sub-pixel gray value distribution of the frame, via the control circuit of the display control system or the front end operating system, such that a gray level voltage number corresponding to a plurality of sub-pixel gray values in the predetermined region which has a relatively larger statistical number (or a relatively higher ratio) is increased (i.e. quantized to a relatively greater extent), and a gray level voltage number corresponding to a plurality of sub-pixel gray values in the predetermined region which has a relatively smaller statistical number (or a relatively lower ratio) is decreased (i.e. quantized to a relatively lesser extent).

Further, the plurality of sub-pixel gray values in the predetermined region which has a relatively larger statistical number reflects that the statistical number of the plurality of sub-pixel gray values in the predetermined region is greater than a first predetermined threshold, or the statistical ratio of the plurality of sub-pixel gray values in the predetermined region is greater than the first predetermined threshold. On the other hand, the plurality of sub-pixel gray values in the predetermined region which has a relatively smaller statistical number reflects that the statistical number of the plurality of sub-pixel gray values in the predetermined region is smaller than a second predetermined threshold, or the statistical ratio of the plurality of sub-pixel gray values in the predetermined region is smaller than the second predetermined threshold.

For instance, if a frame has 100 red sub-pixels, gray values of 50 red sub-pixels are between a predetermined region of 0~44 and gray values of the other 50 red sub-pixels are between a predetermined region of 176~255, the gamma reference voltage can be adjusted so a gray level voltage number corresponding to a plurality of sub-pixel gray values in the predetermined regions of 0~44 and 176~255 is increased, and a gray level voltage number corresponding to a plurality of sub-pixel gray values in the predetermined region of 45~175 is decreased, or even becomes zero.

In another example, if a frame has 100 red sub-pixels, wherein gray values of 80 red sub-pixels are between a predetermined region of 0~44, gray values of 10 red sub-pixels are between a predetermined region of 45~175, and gray values of the other 10 red sub-pixels are between a predetermined region of 176~255, the gamma reference voltage can be adjusted so a gray level voltage number corresponding to a plurality of sub-pixel gray values in the predetermined region of 0~44 is increased, and a gray level voltage number corresponding to a plurality of sub-pixel gray values in the predetermined regions of 45~175 and 176~255 are decreased.

Figure 2:
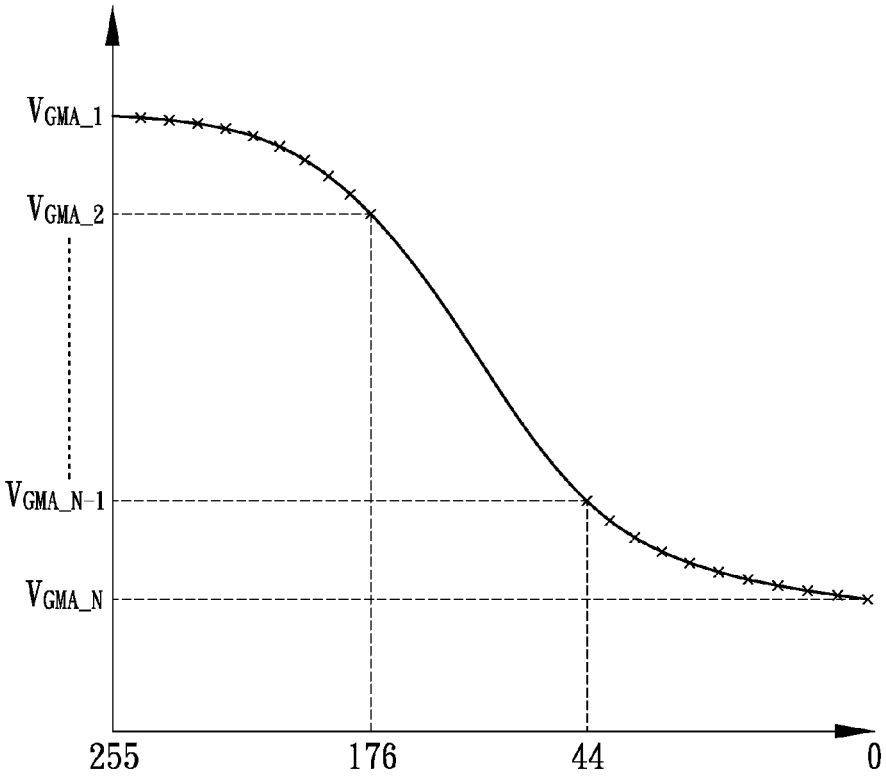
FIG. 2(PRIOR ART)
FIG. 2 is a diagram illustrating a gamma curve corresponding to a conventional liquid crystal display panel.
Figure 4:
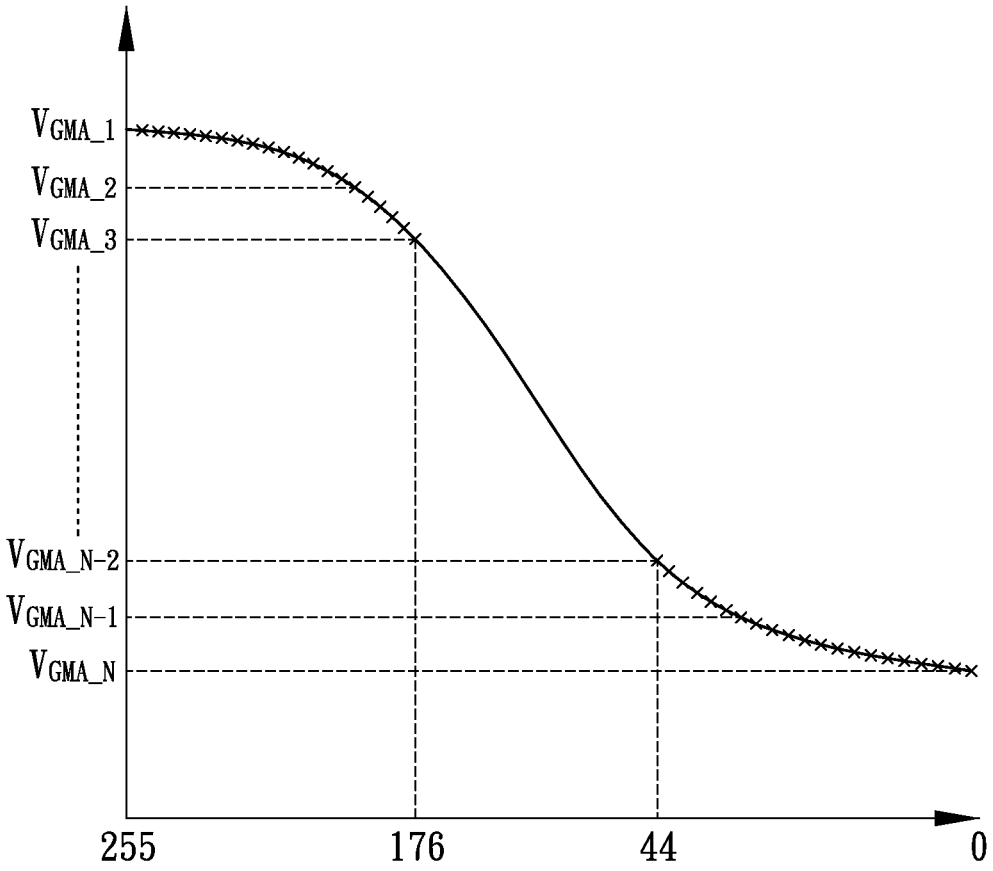
FIG. 4 is a diagram illustrating a gamma curve after being adjusted by a method for adjusting a gamma curve according to an embodiment of the present disclosure.

Please refer to FIG. 2 and FIG. 4 together. FIG. 4 is a diagram illustrating a gamma curve after being adjusted by a method for adjusting a gamma curve according to an embodiment of the present disclosure. In the present embodiment, gray values of 40% of the red sub-pixels are in the predetermined region of 0~44, gray values of 40% of the red sub-pixels are in the predetermined region of 45~175, and gray values of 20% of the red sub-pixels are in the predetermined region of 176~255. Hence, compared to gamma voltages $V_{GMA_2}$, $V_{GMA_3}$, $V_{GMA_N-2}$ and $V_{GMA_N-1}$ of the gamma curve in FIG. 2, gamma reference voltages $V_{GMA_2}$ and $V_{GMA_3}$ in FIG. 4 are increased, and gamma reference voltages $V_{GMA_N-2}$ and $V_{GMA_N-1}$ in FIG. 4 are decreased, for increasing a gray level voltage number corresponding to a plurality of sub-pixel gray values in the predetermined region of 0~44 from 10 to 20, and increasing a gray level voltage number corresponding to a plurality of sub-pixel gray values in the predetermined region of 176~255 from 10 to 20.

Numerical data in the above-mentioned embodiments are merely for exemplary purposes, without any intention to limit the scope of the present disclosure thereto. More specifically, the gray level voltage number generated by two consecutive gamma reference voltages, the predetermined regions, the first predetermined threshold, the second predetermined threshold, the first predetermined ratio and the second predetermined ratio can all be adjusted according to practical needs. Further, although the red sub-pixel is utilized in the above-mentioned embodiments, the present disclosure is not limited thereto. The sub-pixel can also be blue, green, cyan-blue, purple, yellow, orange, white or other colors.

(An Embodiment of a Gamma Voltage Generator)

Figure 5:
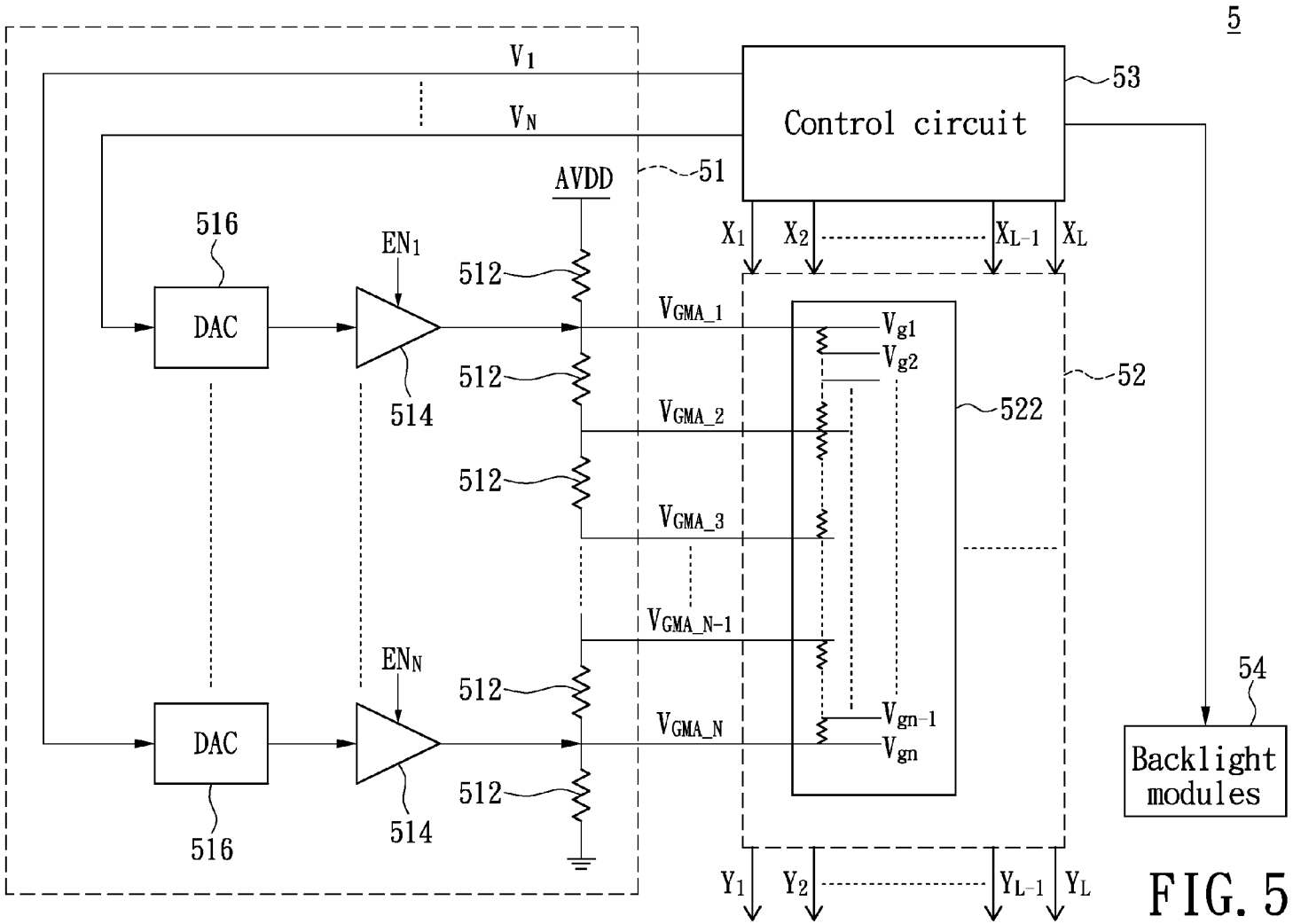
FIG. 5 is a circuit diagram illustrating a display control system according to an embodiment of the present disclosure.

Please refer to FIG. 5. FIG. 5 is a circuit diagram illustrating a display control system according to an embodiment of the present disclosure. The control display system 5 comprises a gamma voltage generator 51, a source driving circuit 52, a control circuit 53 and a backlight module 54. The control circuit 53 is electrically connected to the gamma voltage generator 51, the source driving circuit 52 and the backlight module 54.

The gamma voltage generator 51 receives a system voltage AVDD and generates a plurality of gamma reference voltages $V_{GMA_1}$~$V_{GMA_N}$ according to a plurality of resistors 512 coupled in series and a plurality of control signals of the control circuit 53. A gray level voltage generator 522 of the source driving circuit 52 in the display control system 5 generates gray level voltages $V_{g1}$~$V_{gn}$ according to the plurality of gamma reference voltages $V_{GMA_1}$~$V_{GMA_N}$ received.

Since the gamma voltage generator 51 can adjust the gamma reference voltages $V_{GMA_1}$~$V_{GMA_N}$ generated according to voltage adjusting signals $V_1$~$V_N$ and enabling selection signals $EN_1$~$EN_N$, a plurality of gray level voltage numbers corresponding to a plurality of sub-pixel gray values in different predetermined regions can be changed, such that the gamma curve can be accordingly shifted (i.e. towards the left or towards the right).

The gray level voltages $V_{g1}$~$V_{gi}$ are generated according to gamma reference voltages $V_{GMA_1}$ and $V_{GMA_2}$. The gray level voltages $V_{gk}$~$V_{gn}$ are generated according to gamma reference voltages $V_{GMA_i-1}$ and $V_{GMA_i}$. Similarly, other gray level voltages can be generated in the same principle which depends on the two consecutive gamma reference voltages $V_{GMA_i-1}$ and $V_{GMA_i}$.

The control circuit 53 is used for receiving gray values of sub-pixels of a plurality of colors of a frame, and generating a plurality of control signals $X_1$~$X_L$ accordingly. The source driving circuit 52 receives the control signals $X_1$~$X_L$ of the corresponding sub-pixels, and selects one of the gray level voltages $V_{g1}$~$V_{gn}$ to be the driving voltage $Y_1$~$Y_L$ for a corresponding sub-pixel according to each of the received control signals $X_1$~$X_L$, for controlling a rotation of each corresponding liquid crystal.

In an embodiment of the present disclosure, the control circuit 53 calculates a sub-pixel gray value distribution of each color, and generates voltage adjusting signals $V_1$~$V_N$ and enabling selection signals $EN_1$~$EN_N$ according to the sub-pixel gray value distribution of each color. This way, gamma reference voltages $V_{GMA_1}$~$V_{GMA_N}$ generated by the gamma voltage generator 51 can be dynamically adjusted via the control circuit 53 so as to match a sub-pixel gray value distribution of a corresponding color. In other words, the control circuit 53 increases a gray level voltage number corresponding to a plurality of sub-pixel gray values in the predetermined region which has a relatively larger statistical number (or a relatively higher ratio), and decreases a gray level voltage number corresponding to a plurality of sub-pixel gray values in the predetermined region which has a relatively smaller statistical number (or a relatively lower ratio). This way, contrast and display quality of the frame can be further improved.

In addition, the control circuit 53 can also control brightness of a colored light source emitted by the backlight module 54 according to a degree of color shift or missing color of a frame, for saving power. At the same time, the control circuit 53 can also generate voltage adjusting signals $V_1$~$V_N$ and enabling selection signals $EN_1$~$EN_N$ according to the degree of color shifting or color missing of the frame for distorting the gamma curve. Subsequently, the control circuit 53 or the front end operating system can compensate a sub-pixel gray value of each colored sub-pixel according to a color distortion portion, so the brightness represented by the sub-pixel gray value of each colored sub-pixel is close to the brightness of when the light source is not dimmed or the gamma curve is not distorted.

Take a plurality of colored light sources of the backlight module 54 to be red, green and blue colored light sources as an example. When the frame is more of blue and green, the red light source is dimmed and the gamma curve corresponding to the red sub-pixel is distorted towards the left. The control circuit 53 or the front end operating system then compensates a sub-pixel gray value of each colored sub-pixel according to the color distortion portion, so the brightness represented by the sub-pixel gray value of each colored sub-pixel is close to the brightness of when the light source is not dimmed or the gamma curve is not distorted.

The gamma voltage generator 51 comprises a plurality of resistors 512 coupled in series, a plurality of buffer amplifiers 514 and a plurality of digital-to-analog converters (DAC) 516. A first resistor of the plurality of resistors 512 coupled in series receives the system voltage AVDD and a last resistor of the plurality of resistors 512 coupled in series is electrically connected to the ground potential. A connection point between any two neighboring resistors 512 is electrically connected to an output terminal of a corresponding buffer amplifier 514 for outputting a corresponding gamma reference voltage. An input terminal of each buffer amplifier 514 is electrically connected to an output terminal of a corresponding DAC 516.

The input terminal of each DAC 516 receives a corresponding voltage adjusting signal $V_1$~$V_N$, performs digital-to-analog conversion to the corresponding voltage adjusting signal $V_1$~$V_N$ and then outputs the converted signal to a corresponding buffer amplifier 514. Each of the buffer amplifiers 514 is controlled by a corresponding enabling selection signal $EN_1$~$EN_N$.

In another embodiment, the DAC 516 can be replaced by a voltage switching device. The voltage switching device can select one of a plurality of voltage levels as an output voltage to be outputted to the buffer amplifier 514 according to a corresponding voltage adjusting signal $V_1$~$V_N$. Simply put, the DAC 516 can be replaced by any voltage generator that is able to generate a voltage signal according to a voltage adjusting signal.

(Another Embodiment of a Method for Adjusting a Gamma Curve)

Figure 6:
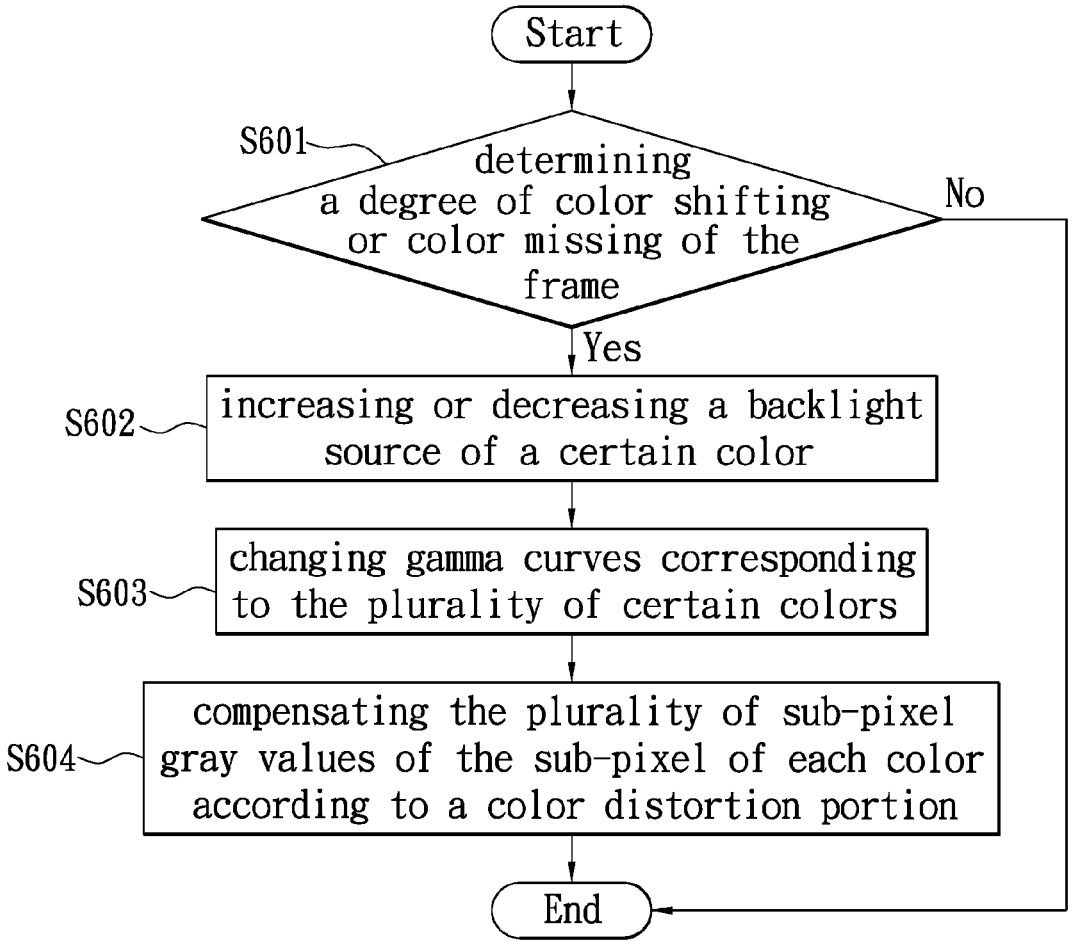
FIG. 6 is a flow chart illustrating a method for adjusting a gamma curve according to another embodiment of the present disclosure.

Please refer to FIG. 6. FIG. 6 is a flow chart illustrating a method for adjusting a gamma curve according to another embodiment of the present disclosure. The method for the adjusting gamma curve in FIG. 6 can be utilized in a display control system and can be realized via hardware or a combination of software and hardware. The display control system can be utilized for backlight or a self-light-emitting display apparatus, such as a liquid crystal display (LCD) device or an organic light emitting diode display (OLED) device. Further, the method for adjusting the gamma curve in FIG. 6 can also be combined with the method for adjusting the gamma curve in FIG. 3 to be utilized in the display control system.

Firstly, in step S601, a control circuit (e.g. a timing controller) of the display control system or a front end operating system analyzes a frame for a degree of color shift or missing color. For instance, a degree of color shift or missing color is analyzed by calculating a sub-pixel gray value distribution/statistics of each colored sub-pixels of the frame. If the frame has color shifting or color missing, step S602 proceeds further. If the frame does not have color shifting or color missing, the method for adjusting the gamma curve is terminated.

In step S602, the control circuit of the display control system controls the backlight module to dim a colored light source of a certain color according to a degree of color shifting or color missing of the frame. In step S603, the control circuit of the display control system controls the gamma reference voltage generated by the gamma voltage generator for deforming a gamma curve of the certain color. In step S604, the control circuit (e.g. a timing controller) of the display control system or the front end operating system compensates a sub-pixel gray value of each colored sub-pixel according to a color distortion portion, so the brightness represented by the sub-pixel gray value of each colored sub-pixel is close to the brightness of when the light source is not dimmed or the gamma curve is not deformed.

Figure 7:
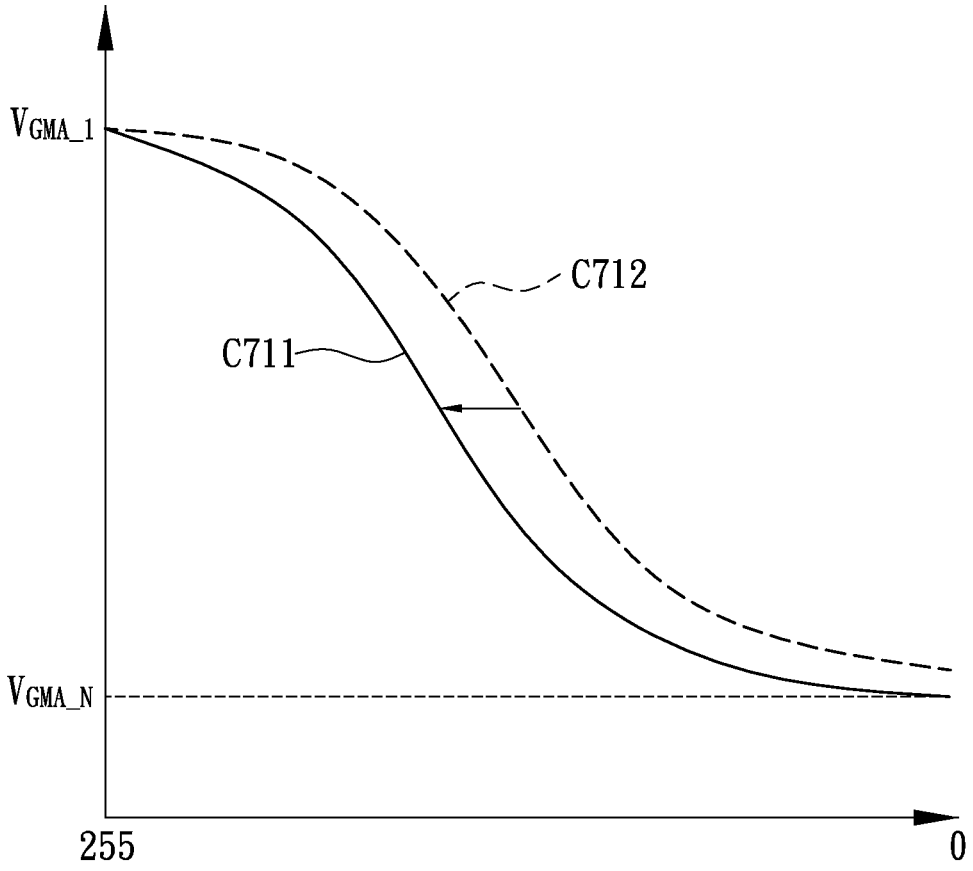
FIG. 7 is a diagram illustrating a gamma curve after being adjusted by a method for adjusting a gamma curve according to another embodiment of the present disclosure.

Please refer to FIG. 7. FIG. 7 is a diagram illustrating a gamma curve after being adjusted by the method for adjusting a gamma curve according to another embodiment of the present disclosure. Take a plurality of colored light sources of a backlight module to be red, green and blue as an example. When a frame is lack of red, the red light source is dimmed and the gamma curve corresponding to the red sub-pixel is distorted towards the left (i.e. the gamma curve C711 is shifted towards the left to become the gamma curve C712). A control circuit or a front end operating system then compensates a sub-pixel gray value of each colored sub-pixel according to a color distortion portion, so the brightness represented by the sub-pixel gray value of each colored sub-pixel is close to the brightness of when the light source is not dimmed or the gamma curve is not deformed.

Figure 8:
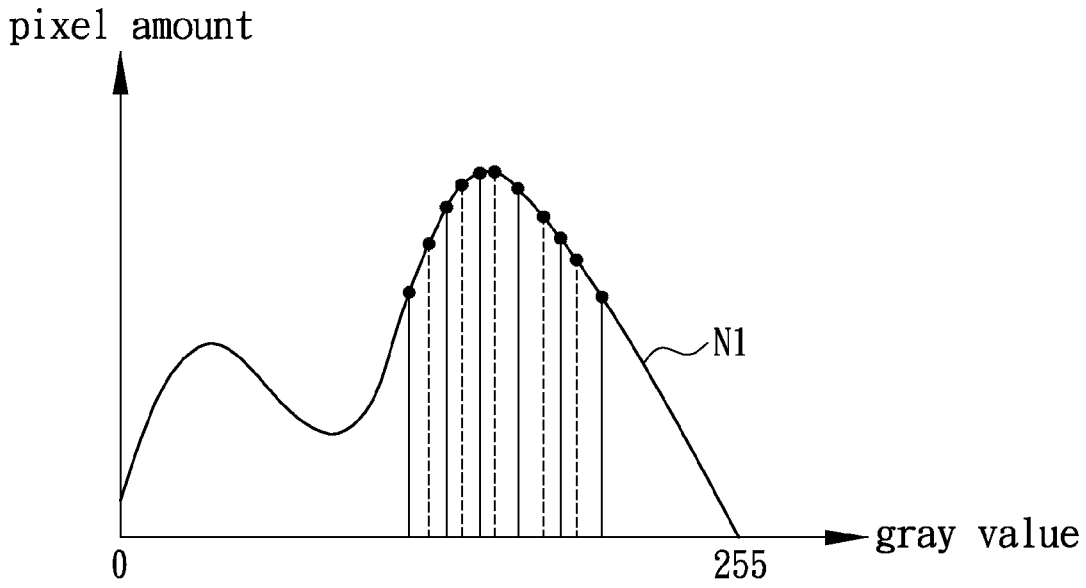
FIG. 8 is a diagram illustrating pixel statistics after being adjusted by a method for adjusting a gamma curve according to another embodiment of the present disclosure.

Please refer to FIG. 8. FIG. 8 is a diagram illustrating pixel statistics after being adjusted by the method for adjusting a gamma curve according to another embodiment of the present disclosure. In above-mentioned embodiments, by dynamically adjusting the gamma reference voltages $V_{GMA_1}$~$V_{GMA_N}$, the control circuit 53 can increase a gray level voltage number corresponding to a plurality of sub-pixel gray values in the predetermined region which has a relatively larger statistical number (or a relatively higher ratio), and decrease a gray level voltage number corresponding to a plurality of sub-pixel gray values in the predetermined region which has a relatively smaller statistical number (or a relatively lower ratio). This way, as shown by the pixel statistical curve N1 in FIG. 8, each solid vertical line corresponds to a point of a gray value versus a pixel amount before and after adjustment, and the portion with higher brightness has more gray values, as shown by the dotted lines. Hence the contrast and the display quality of the frame can be further improved.

Figure 9:
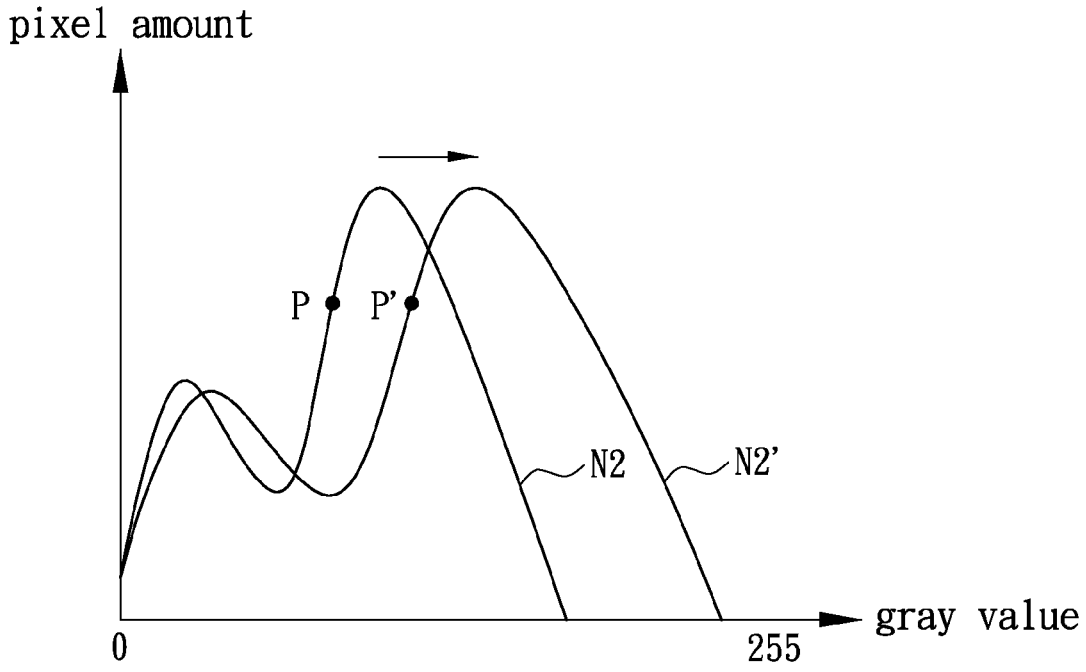
FIG. 9 is a diagram illustrating pixel statistics before and after being adjusted by a method for adjusting a gamma curve according to another embodiment of the present disclosure.

Please refer to FIG. 9. FIG. 9 is a diagram illustrating pixel statistics before and after being adjusted by the method for adjusting a gamma curve according to another embodiment of the present disclosure. N2 is a pixel statistical curve before adjustment. The pixel statistical curve N2, before adjustment, has relatively more dark state. It can be observed, in a pixel statistical curve N2', that the gray values have increased after adjustment. For instance, a point P with a relatively lower gray value is shifted to a point P' with a relatively higher gray level. This way, brightness of the backlight source can be reduced so the power consumption of the backlight source is reduced while achieving similar display effects, for saving power.

(Possible Effects of the Embodiments)

In summary, the method for adjusting a gamma curve according to embodiments of the present disclosure can increase (i.e. quantized to a relatively greater extent) a gray level voltage number corresponding to a plurality of sub-pixel gray values in a predetermined region which has a relatively larger statistical number (or a relatively higher ratio), and decrease (i.e. quantized to a relatively lesser extent) a gray level voltage number corresponding to a plurality of sub-pixel gray values in a predetermined region which has a relatively smaller statistical number (or a relatively lower ratio). Hence, the method for adjusting the gamma curve can effectively increase the contrast and the display quality of a frame.

Further, an embodiment of the present disclosure provides a method for adjusting a gamma curve. The method can dim a colored light source of a certain color according to a degree of color shifting or color missing of a frame, so as to deform the gamma curve for reducing power consumption of a backlight module. The method for adjusting the gamma curve then can compensate a sub-pixel gray value of each colored sub-pixel according to a color distortion portion, so the brightness represented by the sub-pixel gray value of each colored sub-pixel is close to the brightness of when the light source is not dimmed or the gamma curve is not deformed.

In addition, an embodiment of the present disclosure provides a simple structured gamma voltage generator. The gamma generator can adjust a plurality of gamma reference voltages via a control circuit, for increasing (i.e. quantized to a relatively greater extent) a gray level voltage number corresponding to a plurality of sub-pixel gray values in a predetermined region which has a relatively larger statistical number (or a relatively higher ratio), and decreasing (i.e. quantized to a relatively lesser extent) a gray level voltage number corresponding to a plurality of sub-pixel gray values in the predetermined region which has a relatively smaller statistical number (or a relatively lower ratio). In other embodiments, the gamma voltage generator can even adjust a plurality of gamma reference voltages via a control circuit, for deforming the gamma curve.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A method for adjusting a gamma curve for a display control system of a display apparatus, comprising:

analyzing a pixel gray value distribution of each frame and a sub-pixel gray value distribution of each of a plurality colors; and dynamically adjusting at least a gamma reference voltage, a curvature and a function according to the pixel gray value distribution and the sub-pixel gray value distribution of each color, for increasing a gray level voltage number corresponding to pluralities of pixel gray values and sub-pixel gray values in at least a predetermined region which has a relatively larger statistical number or a relatively higher ratio, and decreasing a gray level voltage number corresponding to pluralities of pixel gray values and sub-pixel gray values in at least a predetermined region which has a relatively smaller statistical number or a relatively lower ratio.

2. The method for adjusting the gamma curve according to claim 1, wherein the pixel gray value distribution of each frame and the sub-pixel gray value distribution of each color are obtained according to calculating a statistical number and a statistical ratio of the pixel gray value distribution of the frame to the plurality of sub-pixel gray values of each color in each predetermined region.

3. The method for adjusting the gamma curve according to claim 2, wherein the plurality of sub-pixel gray values in the predetermined region which has the relatively larger statistical number is defined as a statistical number of the plurality of sub-pixel gray values in the predetermined region that is greater than a first predetermined threshold, or a statistical ratio of the plurality of sub-pixel gray values in the predetermined region is greater than the first predetermined threshold; and the plurality of sub-pixel gray values in the predetermined region which has the relatively smaller statistical number is defined as a statistical number of the plurality of sub-pixel gray values in the predetermined region that is smaller than a second predetermined threshold, or a statistical ratio of the plurality of sub-pixel gray values in the predetermined region is smaller than the second predetermined threshold.

4. The method for adjusting the gamma curve according to claim 1, wherein the plurality of colors comprises white, red, blue, green, cyan-blue, purple, yellow and orange.

5. The method for adjusting the gamma curve according to claim 1, further comprising:

determining a degree of color shifting or color missing of the frame;

if the frame having color shifting or color missing, dynamically dimming colored light sources of a plurality of certain colors; and changing gamma curves corresponding to the plurality of certain colors.

6. The method for adjusting the gamma curve according to claim 5, wherein the degree of color shifting or color missing of the frame is determined by calculating a sub-pixel gray value distribution or a statistical value of the plurality of sub-pixels of each color in the frame.

7. The method for adjusting the gamma curve according to claim 5, wherein the gamma curves corresponding to the plurality of certain colors are changed by adjusting at least a gamma reference voltage.

8. The method for adjusting the gamma curve according to claim 5, further comprising:

compensating the plurality of sub-pixel gray values of the sub-pixel of each color according to a color distortion portion for allowing brightness represented by the plurality of sub-pixel gray values of each color being close to brightness of when a light source not being dimmed or the gamma curve not being distorted.

9. A display apparatus, comprising a display control system, wherein the display control system analyzes a pixel gray value distribution of each frame and a sub-pixel gray value distribution of each of a plurality of colors, and dynamically adjusts at least a gamma reference voltage, a curvature and a function according to the pixel gray value distribution and each color, for increasing a gray level voltage number corresponding to a plurality of sub-pixel gray values in at least a predetermined region which has a relatively larger statistical number or a relatively higher ratio, and decreasing a gray level voltage number corresponding to a plurality of sub-pixel gray values in at least a predetermined region which has a relatively smaller statistical number or a relatively lower ratio.

10. The display apparatus according to claim 9, further comprising a gamma voltage generator including:

a plurality of resistors coupled in series, wherein a first resistor of the plurality of resistors coupled in series is electrically connected to a system voltage, a last resistor of the plurality of resistors coupled in series is electrically connected to a ground voltage, and a connection point of any two neighboring resistors is used for outputting a corresponding gamma reference voltage;

a plurality of buffer amplifiers, wherein an output terminal of each of the buffer amplifiers is electrically connected to one of the corresponding connection points of two neighboring resistors, and each of the plurality of buffer amplifiers is simultaneously asserted by a corresponding enabling selection signal; and a plurality of control voltage generators, wherein an output terminal of each of the plurality of control voltage generators is electrically connected to an input terminal of one of the corresponding buffer amplifiers, and each of the plurality of control voltage generators receives a corresponding voltage adjusting signal to generate a voltage signal.

11. The display apparatus according to claim 10, wherein the plurality of control voltage generators is a plurality of digital-to-analog converters (DAC) or a plurality of voltage switching devices.

12. The display apparatus according to claim 9, wherein the sub-pixel gray value distribution of each color is obtained according to calculating a statistical number and a statistical ratio of a plurality of sub-pixel gray values of each color in each predetermined region.

13. The display apparatus according to claim 12, wherein the plurality of sub-pixel gray values in the predetermined region which has the relatively larger statistical number is defined as a statistical number of the plurality of sub-pixel gray values in the predetermined region that is greater than a first predetermined threshold, or a statistical ratio of the plurality of sub-pixel gray values in the predetermined region is greater than the first predetermined threshold, and the plurality of sub-pixel gray values in the predetermined region which has the relatively smaller statistical number is defined as a statistical number of the plurality of sub-pixel gray values in the predetermined region that is smaller than a second predetermined threshold, or a statistical ratio of the plurality of sub-pixel gray values in the predetermined region is smaller than the second predetermined threshold.

14. The display apparatus according to claim 9, wherein the plurality of color comprises white, red, blue, green, cyan-blue, purple, yellow and orange.

15. The display apparatus according to claim 9, further comprising:

determining a degree of color shifting or color missing of the frame;

if the frame has color shifting or color missing, dynamically dimming colored light sources of a plurality of certain colors; and changing gamma curves corresponding to the plurality of certain colors.

16. The display apparatus according to claim 15, wherein the degree of color shifting or color missing of the frame is determined by calculating the sub-pixel gray value distribution or a statistical value of the plurality of sub-pixels of each color in the frame.

17. The display apparatus according to claim 15, wherein the gamma curves corresponding to the plurality of certain colors are changed by adjusting at least a gamma reference voltage.

18. The display apparatus according to claim 15, further comprising:

compensating the plurality of sub-pixel gray values of each color according to a color distortion portion for allowing brightness represented by the plurality of sub-pixel gray values of each color being close to brightness of when a light source not being dimmed or the gamma curve not being distorted.

19. The display apparatus according to claim 9, wherein the display control system comprises a gamma voltage generator, a source driving circuit, a control circuit and a backlight module, wherein the control circuit is coupled to the gamma voltage generator, the source driving circuit and the backlight module, the source driving circuit is coupled to the gamma voltage generator and the gamma voltage generator generates a plurality of gray level voltages $V_{gl}$-$V_{gn}$.

20. The display apparatus according to claim 19, wherein the gamma voltage generator comprises:

a plurality of resistors, coupled in series, wherein a first resistor of the plurality of resistors coupled in series is electrically connected to a system voltage, a last resistor of the plurality of resistors coupled in series is electrically connected to a ground voltage, and a connection point of any two neighboring resistors is used for outputting a corresponding gamma reference voltage;

a plurality of buffer amplifiers, wherein an output terminal of each of the plurality of buffer amplifiers is electrically connected to a connection point of two corresponding neighboring resistors, and each of the plurality of buffer amplifiers is asserted by a corresponding enabling selection signal; and a plurality of control voltage generators, wherein an output terminal of each of the plurality of control voltage generators is electrically connected to an input terminal of one of the corresponding buffer amplifiers, and each of the plurality of control voltage generators receives a corresponding voltage adjusting signal to generate a voltage signal.

21. The display apparatus according to claim 20, wherein the plurality of control voltage generators is a plurality of digital-to-analog converters (DAC) or a plurality of voltage switching devices.

22. The display apparatus according to claim 20, wherein the source driving circuit receives the plurality of control signals $X_1$-$X_L$, and selects one of the gray level voltages $V_{g1}$-$V_{gn}$ to be a driving voltage $Y_1$-$Y_L$ of a corresponding sub-pixel, for controlling a rotation of each corresponding liquid crystal, allowing brightness represented by the plurality of sub-pixel gray values of each color being increased and close to brightness of when a light source not being dimmed or the gamma curve not being distorted.

23. The display apparatus according to claim 19, wherein the control circuit is used for receiving sub-pixel gray values of the plurality of colors of the frame, and generating a plurality of control signals $X_1$-$X_L$ accordingly.

* * * * *